US005791281A

United States Patent [19]

Davidson

[11] Patent Number: 5,791,281

[45] Date of Patent: Aug. 11, 1998

[54] LIFTING HARNESS FOR A DINGHY

[76] Inventor: Robert Davidson, 58 S. Gate La., Southport, Conn. 06490

[21] Appl. No.: 835,054

[22] Filed: Apr. 3, 1997

[51] Int. Cl.[6] ..... B63B 23/00

[52] U.S. Cl. ..... 114/377; 114/365

[58] Field of Search ..... 114/44, 51, 365, 114/366, 368, 377; 244/138 R

[56] References Cited

U.S. PATENT DOCUMENTS

| | | | |
|---|---|---|---|
| 3,383,721 | 5/1968 | Adams, Jr. | 114/377 |
| 4,364,326 | 12/1982 | Pike | 114/366 |
| 4,406,244 | 9/1983 | Buchan et al. | 114/368 |

*Primary Examiner*—Jesus D. Sotelo

*Attorney, Agent, or Firm*—James V. Harmon

[57] ABSTRACT

A lifting harness for hoisting a dinghy includes a hoisting ring having a top and a bottom. The ring has a portion at the top for fastening the ring to an overhead hoist. The ring also includes a horizontally extending strap-supporting slide bar for supporting a stern strap and a bow supporting member as a part of the ring for securing a bow strap to the ring. The stern strap extends over the slide bar and includes an opening at each end for surrounding the rear portion of the pontoon tube. The stern strap is adapted to slide to the left or to the right across the slide bar relative to the dinghy for balancing the dinghy. A bow strap is provided and includes an upper end that is connected to the bow support member. The bow strap extends downwardly from the ring and includes a means for connecting the bow strap to the bow of the dinghy.

10 Claims, 2 Drawing Sheets

LIFTING HARNESS FOR A DINGHY

FIELD OF THE INVENTION

This invention relates to lifting harnesses and more particularly to a harness assembly for lifting a boat out of the water.

BACKGROUND OF THE INVENTION

Yachts, sailboats, trawlers and other boats commonly employ a smaller boat or dinghy, especially during a cruise, to enable the crew to reach shore from anchorage and for other purposes. One popular form of dinghy has an inflated rubber hull that includes a pair of aft-projecting pontoon tubes and a lifting ring at the bow. Dinghies of this kind have either an inflatable or rigid floor, which is usually formed from wood or aluminum, and are often equipped with an outboard motor. Although made largely of flexible material, these dinghies are heavy, awkward to move by hand, and difficult to lift manually out of the water for storage, repair, cleaning or to prevent theft. To overcome these and other difficulties, it is a primary object of the present invention to provide an improved lifting harness for a dinghy that can be used for hoisting the dinghy out of the water for storage, repair, cleaning and the like.

A more specific object is to provide an improved harness that is low in cost, easy to use, rugged in construction, and enables the dinghy to be quickly and easily balanced just before being lifted out of the water.

These and other more detailed and specific objects of the present invention will be better understood by reference to the following figures and detailed description which illustrate by way of example but a few of the various forms of the invention within the scope of the appended claims.

SUMMARY OF THE INVENTION

The invention provides a dinghy lifting harness for hoisting a dinghy that has a pair of aft-projecting pontoon tubes at its stern. The harness comprises a hoisting ring having a top and a bottom. The ring has a portion at the top for fastening the ring to an overhead hoist. The ring also includes a horizontally extending strap-supporting slide bar for supporting a stern strap and a bow supporting member as a part of the ring for securing a bow strap to the ring. The stern strap extends over the slide bar and includes an opening at each end for surrounding the rear portion of the pontoon tube. The stern strap is adapted to slide to the left or to the right across the slide bar relative to the dinghy for balancing the dinghy. A bow strap is provided and includes an upper end that is connected to the bow support member. The bow strap extends downwardly from the ring and includes a means for connecting the bow strap to the bow of the dinghy.

THE FIGURES

DETAILED DESCRIPTION OF THE INVENTION

Figure 1:
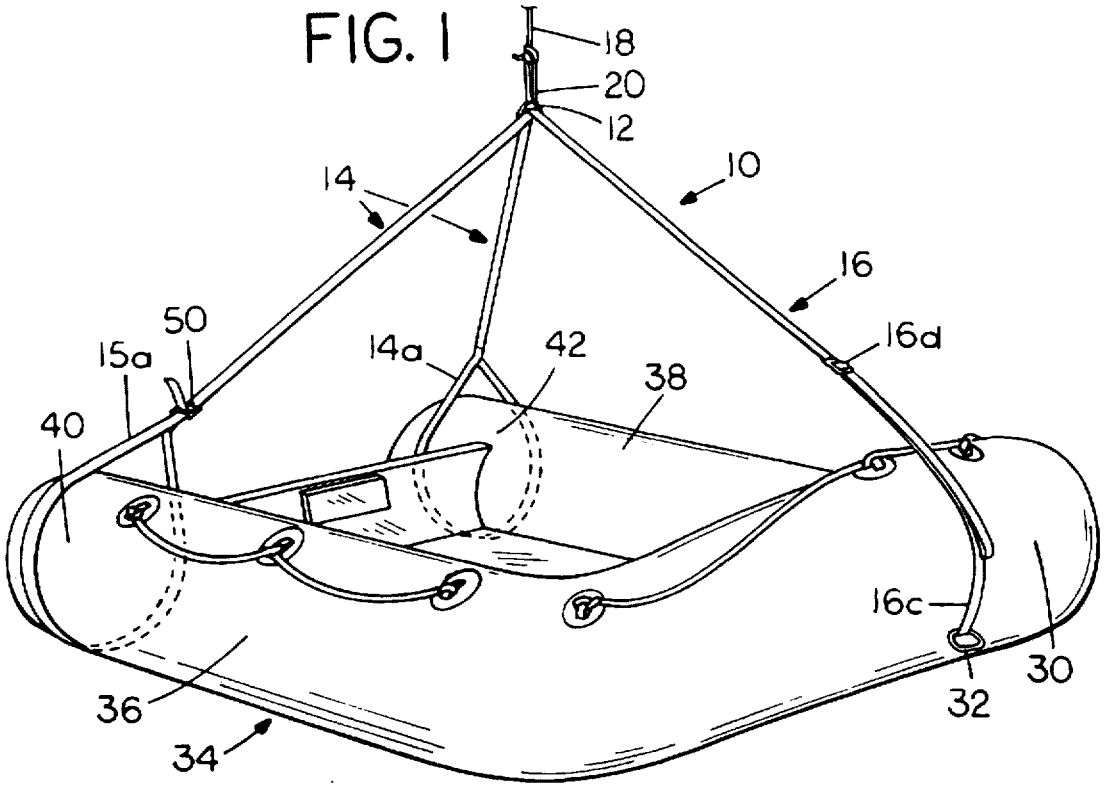
FIG. 1 is a perspective view of a dinghy hoist in accordance with the invention as it appears during use.

A lifting harness for a dinghy indicated generally by the numeral 10 includes three major components: a hoisting ring 12, a stern strap 14 which includes an end segment 15, and bow strap 16.

The hoisting ring 12 which is preferably triangular in shape can have other shapes such as round or oval, if desired. The ring 12 includes a top portion **12*a* and a bottom 12*b*. The top portion 12*a* is used for fastening the ring 12 to an overhead hoist, e.g., a rope 18 which can be provided with a knot or hook 20 at its lower end 20 that extends through the top portion 12*a* of the ring 12. In a typical situation, the hoist 18** can be supported by an on-board lifting crane if present on the yacht (not shown) or simply the halyard for the sail of a sailboat.

Figure 2:
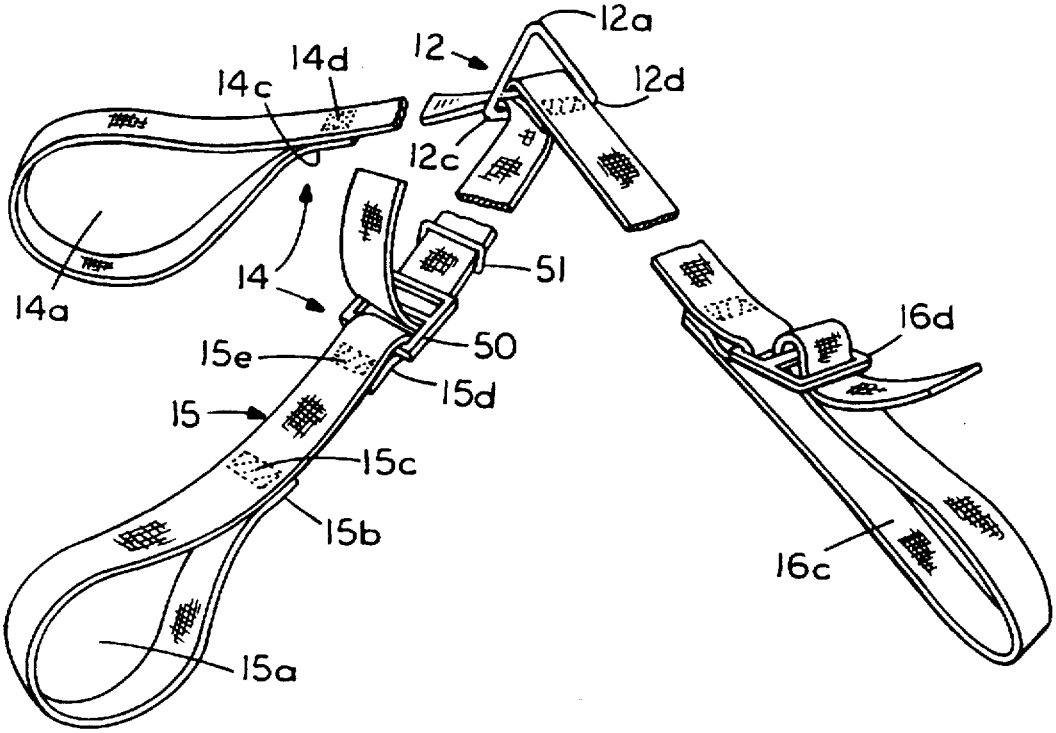
FIG. 2 is a perspective view of the hoist on a larger scale than in FIG. 1, as it appears before use.
Figure 3:
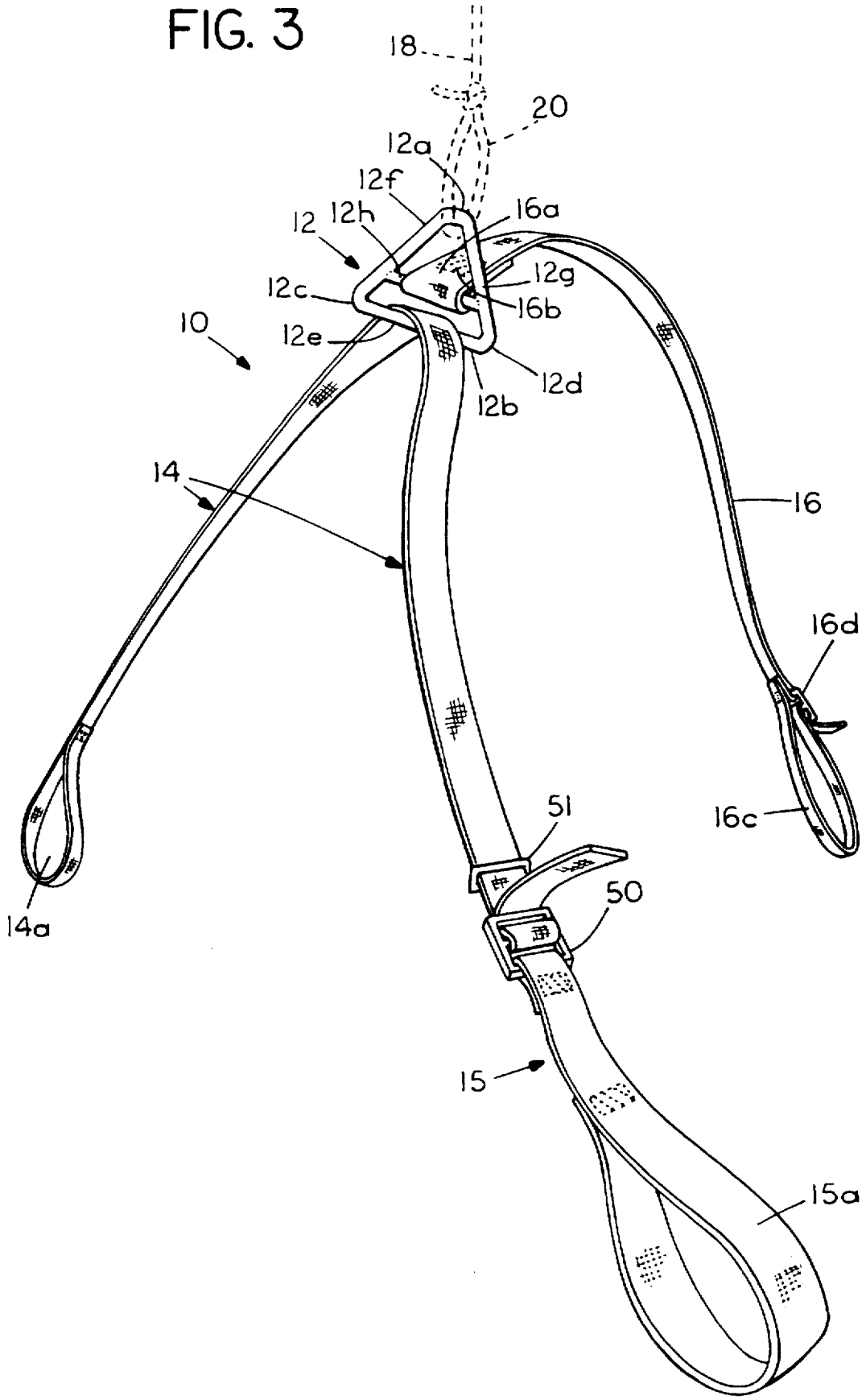
FIG. 3 is a rear perspective view of the dinghy hoist on a somewhat larger scale than in FIG. 2.

Refer especially to FIGS. 2 and 3 with respect to the hoisting ring 12. The hoisting ring 12 in a preferred form of the invention is generally triangular in shape with an apex at the top **12*a*. In this instance the ring 12 has the shape of an equilateral triangle with three corners, the first of which is located at the top portion 12*a*. The other two corners 12*c* and 12*d* are at the bottom 12*b* of the ring at opposite ends of the horizontally extending strap-supporting slide bar 12*e*. The ring 12 includes inclined side bars 12*f* and 12*g* which terminate at the bottom corners 12*c* and 12*d*. Connected between the side bars 12*f* and 12*g* as a part of the ring 12 is a transversely extending bow-supporting member or bar 12*h* for securing the bow strap 16 to the ring 12. Bar 12*h* is spaced vertically above slide bar 12*e* and is parallel to it. The ring 12** can be a metal casting, forging, or heavy wire and is preferably made of stainless steel.

The bow strap 16 is secured to the support member **12*h* by means of a loop 16*a* in the strap 16 which encircles the support member 12*h* and is sewn to itself at 16*b*. The lower end of the strap 16 is provided with a loop 16*c*, the end of which is secured by means of a buckle 16*d* to an intermediate portion of the strap 16 to make the bow strap 16 extensible. The bow strap 16 as shown in FIG. 1 is connected to the clevis 32 at the bow 30 of inflated rubber dinghy 34**.

The inflated rubber dinghy 34 includes a pair of laterally disposed longitudinally extending inflated pontoon tubes 36, 38 which are united at the bow 30. The pontoon tubes 36, 38 include aft projecting pontoon tube portions 40, 42, respectively. The stern strap 14 extends from one side of the dinghy 34 to the other between the rearwardly extending pontoon tube portions 40 and 42. The center portion of the strap 14 extends over the slide bar **12*e* to enable a person to slide strap 14 to the left or right across the slide bar 12*e* relative to the dinghy 34 for balancing the dinghy. It can be seen that rear end portions 40, 42 of the pontoon tubes 36, 38 are enclosed within openings formed by loops 14*a*, 15*a* in the stern strap 14. The loop 14*a* can be formed by looping one end of the strap material back on itself at 14*c* and securing it to an intermediate portion of strap 14 by sewing at 14*a*. The loop 15*a* is formed in a separate strap segment designated 15 at one end of strap 14 and is secured to the strap 14 by means of a buckle 50. The loop 15*a* is formed by looping an end portion 15*b* of strap segment 15 back on an intermediate portion of strap 15 and joining it thereto by means of sewing 15*c*. The strap portion 15 has a loop 15*d* at its upper end which is connected to buckle 50 and is secured to it by means of sewing 15*e*. The strap 14 extends through the buckle 50 and is then passed through a clevis 51 enabling the combined lengths of the straps 14, including portion 15, to be lengthened or shortened as required to fit a dinghy 34** of a particular size.

While the dimensions of the hoist can vary, the straps 14, 15 and 16 are typically about one-to two-inch-wide straps of nylon cargo webbing to provide an overall load capacity of 350 lbs. The buckles **16*b* and 50 can be metal or of plastic such as Delrin® or Acetal. The hoisting ring 12** can have a height of about two-and-one-half inches and a width of about three inches, and is preferably composed of stainless steel.

During use, the stainless steel lifting ring 12 is secured to a hoisting means, such as a rope or halyard 18, by connecting the halyard 18 to the upper portion 12*a* of the ring 12. The bow strap 16 is then adjusted to extend to the bow 30 of the dinghy 34 and is connected as at 32. The loops 14*a* and 15*a* are placed over the rear portions 40, 42 of the pontoon tubes 36, 38. The stern strap 14, 15 is then adjusted by sliding its center portion to the left or right across the slide bar 12*e* relative to the dinghy 34 for balancing the dinghy and to place the dinghy in a horizontal position. The halyard 18 or other hoist can then be used for lifting the dinghy 34 out of the water, as can be seen best by reference to FIG. 1.

The dinghy lifting harness 10 enables a person to conveniently lift the dinghy 34 out of the water and move it as required for storage, repair or for cleaning. A winch (not shown) on the yacht can be used to raise the halyard for lifting the dinghy free of the water. The dinghy 34 can then be positioned on the deck for storage overnight or for longer periods of time, for regular maintenance, or to avoid theft. The harness 10 can be made adjustable for conventional dinghies typically up to 14 feet in length and having pontoon tubes 36, 38 with diameters, for example, up to about 21 inches or more.

The invention is particularly valuable during a long cruise because it eliminates the backbreaking and awkward job of lifting the dinghy out of the water and provides security of the dinghy at night or when the crew is away from the yacht.

Another feature of the invention is its simplicity in not requiring additional hardware, such as U-bolts or other metal "lifting eyes", to be attached to the stern of the dinghy. With the stern loops of the invention lifting the pontoons, the cost of such hardware is eliminated.

Many variations of the present invention within the scope of the appended claims will be apparent to those skilled in the art once the principles described herein are understood.

What is claimed is:

1. A dinghy lifting harness for hoisting a dinghy that has a pair of aft-projecting pontoon tubes at the stern thereof, said harness comprising, a hoisting ring, said hoisting ring having a top and a bottom, said ring having a portion adjacent the top for fastening the ring to an overhead hoist, said ring including a horizontally extending strap-supporting slide bar for supporting a stern strap, said ring including a bow supporting member as a part of the ring for securing a bow strap to the ring, a stern strap extends over the slide bar, said stern strap has a pair of lower ends and an opening at each of the ends for surrounding a rear portion of one of the pontoon tubes, the stern strap has a center portion adapted to be slid by a person to the left or right across the slide bar relative to the dinghy for balancing the dinghy, and a bow strap having an upper end connected to the bow support member of the ring and extending downwardly therefrom and including means for connecting a lower end of the bow strap to the bow of the dinghy.

2. The lifting harness of claim 1 wherein the ring is triangular and includes a pair of inclined side bars that extend downwardly from the top of the ring to the bottom thereof.

3. The lifting harness of claim 1 wherein the stern strap includes a first strap portion and a second strap portion connected to one end thereof and a buckle for lengthening or shortening the combined length of the stern strap.

4. The lifting harness of claim 1 wherein the openings of the stern strap are loops of a predetermined size at each end of the stern strap, each adapted to fit around and enclose the aft-projecting portion of a pontoon tube.

5. The lifting harness of claim 1 wherein the ring includes a pair of parallel laterally extending, vertically spaced apart rigid members formed as a part of the ring, one of said members comprises said slide bar and the other of said members comprises the bow support member.

6. A dinghy lifting harness for hoisting a dinghy that has a pair of aft-projecting pontoon tubes at the stern thereof, said harness comprising, a hoisting ring, said hoisting ring having a top and a bottom, the ring includes a pair of parallel laterally extending, vertically spaced apart members formed as a part of the ring, one of said members comprises a horizontal slide bar and the other of said members comprises the bow support member, said ring has a portion adjacent the top for fastening the ring to an overhead hoist, the bow supporting member is a past of the ring for securing a bow strap to the ring, a stern strap extends over the slide bar and has means at each end for connecting the stern strap to a rear portion of said dinghy, and a bow strap is provided having an upper end connected to the bow support member and extends downwardly therefrom and includes means for connecting a lower end of the bow strap to the bow of the dinghy.

7. The lifting harness of claim 6 wherein the ring is triangular and includes a pair of inclined side bars that extend downwardly from the top of the ring to the bottom thereof.

8. The lifting harness of claim 6 wherein the stern strap includes a first strap portion and a second strap portion connected to one end thereof and a means for lengthening or shortening the combined length of the said two portions of the stern strap.

9. The lifting harness of claim 6 wherein the stern strap has a loop of a predetermined size at each end adapted to fit around and enclose the aftprojecting portion of a pontoon tube.

10. A dinghy lifting harness comprising, a hoisting ring with a means at its upper end for connecting the hoisting ring to an overhead hoist, said ring including a horizontally extending strap-supporting slide bar for supporting a stern strap, a bow strap is connected to the ring and extends forwardly therefrom and includes a connector at its forward end for connecting the bow strap to the bow of a dinghy, a stern strap extends over the slide bar and includes connecting means at each end for fastening the stern strap to each side of the dinghy adjacent the stern thereof, and the stern strap has a center portion in contact with the slide bar that is adapted to be slid to the left or right by a person and is retained in place through frictional contact with the slide bar for balancing the dinghy.

* * * * *